United States Patent [19]

Ornsteen

[11] 4,215,802

[45] Aug. 5, 1980

[54] ADHESIVE GUN HAVING NEEDLE VALVE NOZZLE

[75] Inventor: Robert L. Ornsteen, Cape Neddick, Me.

[73] Assignee: Ornsteen Chemicals, Inc., Seabrook, N.H.

[21] Appl. No.: 958,871

[22] Filed: Nov. 8, 1978

[51] Int. Cl.[2] ..... B67D 5/62

[52] U.S. Cl. ..... 222/146 H; 222/389; 222/504; 222/524; 251/63.6; 251/353

[58] Field of Search ..... 222/146 R, 146 H, 146 HE, 222/261-263, 325, 326, 389, 496, 499, 522, 531, 532, 513, 524, 525, 504, 493; 239/411; 184/39, 54, 56 A, 105 A; 425/381, 563; 251/63, 63.6, 353

[56] References Cited

U.S. PATENT DOCUMENTS

| | | | |
|---|---|---|---|
| 3,076,583 | 2/1963 | Eberspacher | 222/493 |
| 3,877,610 | 4/1975 | Dickey | 222/146 HE |
| 3,951,308 | 4/1976 | Thirtle | 222/146 HE |

*Primary Examiner*—H. Grant Skaggs

*Attorney, Agent, or Firm*—Weingarten, Maxham & Schurgin

[57] ABSTRACT

A needle valve nozzle is employed in a hot melt adhesive gun used to apply thermoplastic adhesive. Actuation of a trigger mechanism supplies pressurized gas to a nozzle chamber which urges the nozzle in an outward direction to an open position, the needle remaining stationary during operation of the nozzle. Deactuation of the trigger mechanism stops the flow of pressurized gas to the chamber and a vent allows the pressurized gas to flow from the chamber, permitting a spring-biasing mechanism to return the nozzle to a closed position. Pressure on the adhesive can also be employed to urge the nozzle to an open position.

14 Claims, 4 Drawing Figures

ADHESIVE GUN HAVING NEEDLE VALVE NOZZLE

FIELD OF THE INVENTION

This invention relates to adhesive dispensing apparatus and more particularly to a reciprocable nozzle needle valve dispenser.

BACKGROUND OF THE INVENTION

Hot melt adhesive guns are known for application of a melted thermoplastic adhesive onto a work surface on which the adhesive solidifies to form a requisite bond. One class of hot melt gun employs a cartridge of normally solid thermoplastic adhesive contained within a chamber and in which the cartridge or portion thereof is heated and melted and by pneumatic action urged through a nozzle of the gun for dispensing onto a work surface. A gun of this type is shown in U.S. Pat. No. 3,764,045 assigned to the assignee of this invention. In other known hot melt guns, a piston is disposed within a chamber and is pneumatically driven along the length of the chamber to urge the adhesive cartridge forward and force the melted adhesive through the gun nozzle. This latter type of gun is shown, for example, in U.S. Pat. No. 3,587,930, where an adhesive chamber is formed by registered first and second cavities with a forward cavity being heated to provide a reservoir of molten adhesive and a rearward cavity being sufficiently cooler to maintain the adhesive in solid form and including a pneumatically-driven piston in sliding engagement with the rearward cavity wall. Another gun of this latter type is shown in U.S. Pat. No. 3,877,610 assigned to the assignee of this invention, and in which a stationary piston is disposed within a cylindrical member which is slidable with respect to the stationary piston upon pneumatic actuation. The cylindrical member is mounted for slidable movement within the adhesive chamber to urge the adhesive forward for melting and dispensing.

Many hot melt guns of the type cited above employ needle valves to dispense the thermoplastic material from the nozzle. A gun of this type is shown, for example, in the aforesaid U.S. Pat. No. 3,587,930, which employs a valve housing and a movable needle which is manually actuable. Needle valves of this nature are subject to carbon buildup on the end of the needle which retards the motion of the needle and which in turn either slows down or completely prevents the closing of the needle valve. In addition, this particular type of valve requires the use of seals to prevent the leakage of glue past the needle when the valve is closed. Of necessity, these seals must be internal and immersed in the adhesive, which produces gumming problems and problems with replacement. Generally, these types of needle valve nozzles use a gland which is adjustable, and the adjustment of this gland poses a problem in that if the gland is adjusted too tightly, the needle does not move freely enough and the glue is not allowed to flow. If the gland is too loose, leaking of the glue occurs. Other types of needle vales employ pneumatic means to actuate them as opposed to the manual device employed above.

SUMMARY OF THE INVENTION

In accordance with the invention, a hot melt adhesive gun is provided having a needle valve nozzle in which the needle is fixed in a stationary position and the nozzle formed about the needle is reciprocable to permit the flow of adhesive from the gun and to seal the nozzle opening during non-use of the gun. The nozzle is pneumatically actuable in response to a manual trigger mechanism which permits the flow of pressurized gas to the means for opening the nozzle. A biasing mechanism is used to maintain the nozzle in a closed position during non-use so that the needle is in sealing engagement with the interior of the nozzle. In one embodiment of the invention, the opening means comprises a pneumatic chamber disposed at the base of the nozzle within the nozzle housing. Upon actuation of the trigger mechanism, pressurized gas is fed into the pneumatic chamber which causes the chamber to expand, thereby urging the nozzle outwardly into an open position and breaking the seal between the nozzle and the tip of the needle. Simultaneously, pressurized gas is also fed into a pneumatic assembly within the glue cylinder which is located behind the nozzle within the gun body. The glue cylinder contains a cartridge of thermoplastic adhesive maintained in a substantially cool condition except at the forward end thereof at which a heater plate is disposed for melting of a portion of the adhesive cartridge for dispensing through the nozzle. Upon actuation of the trigger, gas of suitable operating pressure is applied to the pneumatic assembly for urging the adhesive forward into engagement with the heater plate. Upon release of the trigger, operating pressure is removed both from the pneumatic assembly and from the pneumatic chamber in the nozzle valve to discontinue adhesive flow and to permit closure of the valve.

In another embodiment of the invention, the opening means comprises the pneumatic assembly and the nozzle is opened by the pressure of the glue in the adhesive cartridge. The biasing mechanism is adjusted so as to permit opening of the nozzle only when the pressure in the adhesive cartridge exceeds a predetermined level.

Another embodiment of the invention provides a needle valve nozzle which may be attached to any type of pressurized dispenser, such as a bulk hot melt unit. In this embodiment of the invention, the nozzle is again opened by means of pneumatic pressure applied to a pneumatic chamber upon actuation of a trigger mechanism.

DESCRIPTION OF THE DRAWINGS

The invention will be more fully understood from the following detailed description taken in conjunction with the accompanying drawings in which.

DETAILED DESCRIPTION OF THE INVENTION

Figure 1:
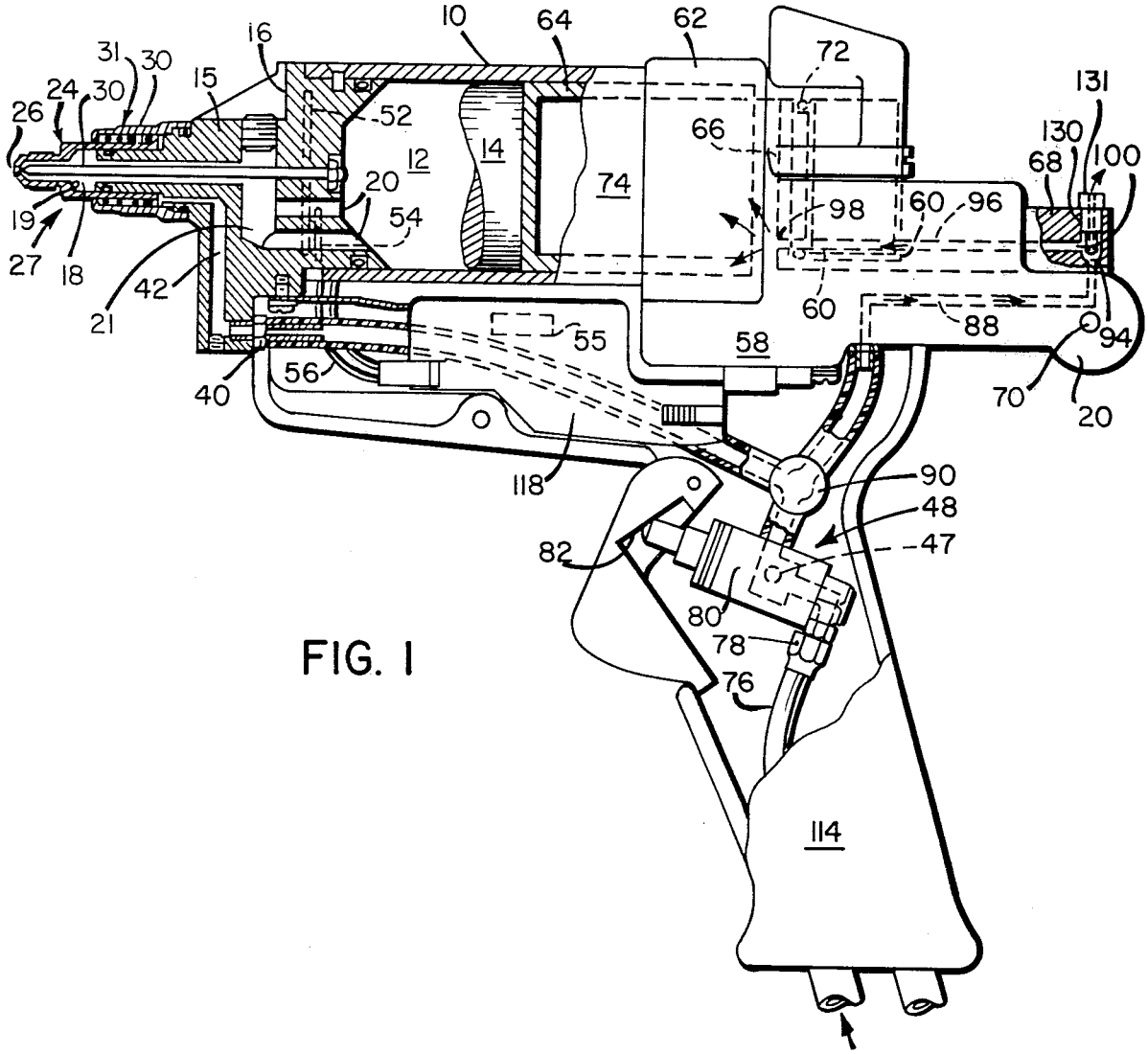
FIG. 1 is a sectional elevation view of an adhesive gun according to a preferred embodiment of the invention.
Figure 4:
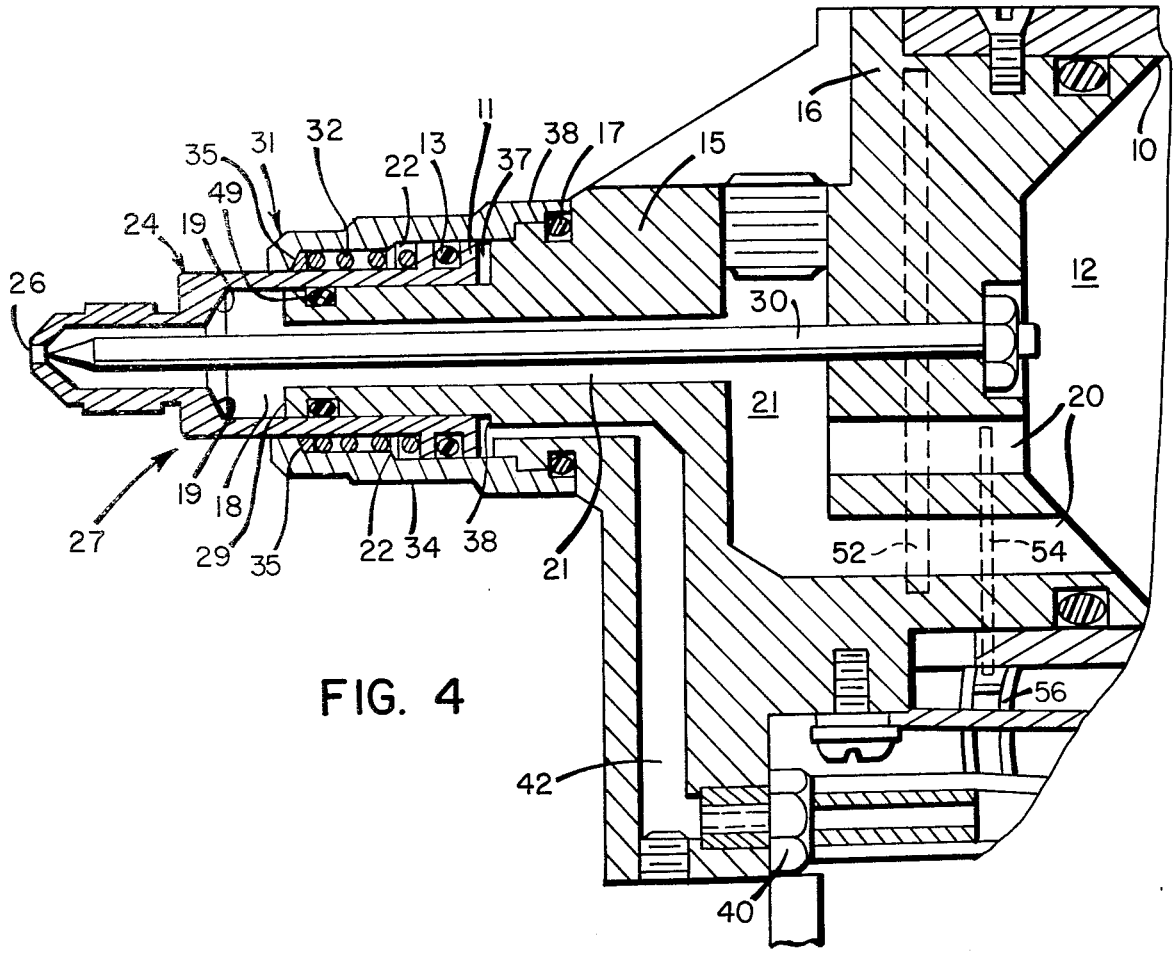
FIG. 4 is a cutaway sectional elevation view of the embodiment of FIG. 1 further illustrating the construction of the nozzle portion thereof.

Referring to FIG. 1, and to FIG. 4, there is shown a hot melt adhesive gun similar to the adhesive gun shown in U.S. Pat. No. 3,877,610 with respect to the adhesive chamber and adhesive propulsion means. An elongated cylindrical tube 10 defines a cylindrical chamber 12 in which a cartridge 14 of thermoplastic adhesive is contained for melting and subsequent dispensing onto a work surface. The cylindrical tube 10 is formed of a thermally insulative material such as silicone impregnated with glass fabric or reinforced Teflon, a registered trademark of DuPont de Nemours E. I. and Company for polytetrafluorethylene, and tube 10 is attached at the forward end thereof to a heater block 16 and heaters 52 into engagement with which adhesive cartridge 14 is urged for rapid melting. Passages 20 extend from the surface confronting chamber 12 through block 16 and connect with a passage 21 which communicates with nozzle valve 27. Thus, melted adhesive is permitted to flow from chamber 12 through passage 21 to nozzle valve 27.

Nozzle valve 27 is provided at the discharge end of the gun to open and close passage 21. Nozzle valve 27 includes a nozzle housing 15, a reciprocable nozzle 24 mounted on the discharge end of housing 15, and a stationary needle 30. Nozzle 24 has a discharge orifice 26 in communication with passage 21 and through which melted adhesive is dispensed. Needle 30 is affixed to heater block 16 and extends therefrom through a portion of passage 21 to nozzle 24. Needle 30 preferably has a cylindrical shape, and discharge orifice 26 is preferably round. The distal end of needle 30 is tapered into a conical configuration so that needle 30 sealingly engages discharge orifice 26 when the valve 24 is in a closed position, thereby preventing the discharge of adhesive therefrom. Needle 30 is formed of a thermally conductive material, typically metal, and thus serves as a heat sink to conduct heat from heater block 16 through passage 21 to adhesive in nozzle 24. This feature insures that the adhesive will remain molten and that it will be at an optimal temperature for bonding when it leaves the exit orifice 26 and is applied to a work surface. A chamber 18 is formed within nozzle 24 adjacent discharge orifice 26. Chamber 18 is defined by inner surface 19 of the nozzle 24 and annular shoulders 29 and is adapted to receive adhesive from passage 21. As adhesive flows to chamber 18, the adhesive acts upon inner surface 19 and shoulders 29 to urge nozzle 24 in an outward direction and to thereby expand chamber 18. An O-ring seal 49 is disposed in housing 15 in sliding and sealing engagement with the inner surface of nozzle 24 to prevent the leakage of adhesive from chamber 18.

A biasing mechanism 31 includes a coil spring 32 disposed between cylinder 34 and nozzle 24. The spring 32 acts upon an inwardly extending flange 35 around the cylinder 34 and an outwardly protruding lip 11 around the nozzle 24 to bias the nozzle 24 towards a closed position in which the needle 30 sealingly engages the discharge orifice 26. An O-ring wiper seal 67, preferably formed of Teflon material, is disposed within cylinder 34 on the inner surface of flange 35 in sliding and sealing engagement with the outer surface of nozzle 24. Seal 67 serves to wipe excess adhesive from the exterior of nozzle 24 and to prevent such adhesive from entering the biasing mechanism 31.

Means for actuating nozzle 24 includes an annular pneumatically actuated chamber 37 which is formed between shoulders 38 on nozzle housing 15 lip 11, and cylinder 34. An O-ring seal 13 is disposed on lip 11 and is in sliding gas sealable relationship with the inner surface of cylinder 34. Another O-ring seal 17 is disposed at the junction of cylinder 34 with the nozzle housing 15. Seals 13, 17 and 49 all serve to seal chamber 37 and to prevent the escape of gas therefrom. Seal 49 also prevents the leakage of adhesive into chamber 37. It also should be noted that seals 13, 17 and 49, as well as seal 67, are all located outside of chamber 12 and not in contact with adhesive and are, therefore, all easily replaceable. A conduit 42 communicates with chamber 37, permitting a flow of pressurized gas thereto from a source. When operating gas is applied to chamber 37, nozzle 24 is urged outward into an open position so that the discharge orifice 26 projects beyond the distal end of needle 30, thereby allowing the discharge of adhesive from discharge orifice 26. Annular shoulder 22 on the inner surface of cylinder 34 prevents nozzle 24 from moving outwardly more than a predetermined distance.

The heater block 16 is formed of a thermally conductive material such as aluminum and includes one or more electrical heaters 52 disposed therein for heating the block to an operating temperature sufficient to melt the adhesive cartridge 14 driven into engagement therewith. A heat sensing means 54 is inserted into block 16 and is connected by leads 56 to a control means 55. Control means 55 maintains the operating temperature of the heater block 16 within a predetermined temperature range by interrupting the power from an electrical power source in response to temperature measurements of the heat sensing means 54 in a manner well known in the art.

In the preferred embodiment, the cylindrical chamber 10 is affixed at its rearward end opposite the discharge end to a saddleplate 58. Plate 58 includes an annular surface 60 of substantially the same diameter as that of the chamber 12 and in alignment therewith to serve as an extension of the lower portion of the chamber for the loading of an adhesive cartridge into chamber 12. Plate 58 includes a cylindrical collar portion 62 which surrounds and engages the rearward end of tube 10 for support thereof. Means within chamber 12 are adapted to drive adhesive cartridge 14 against heaters 52 for melting thereof. This driving means may also serve as a means for actuating nozzle 24, and the driving means includes a cylindrical cup-shaped member 64 slidably disposed within chamber 12 with the closed end confronting heater block 16. A piston plate 66 is disposed within the cylindrical opening of member 64 and is integral with a rearwardly extending member 68 which is pivotally affixed to plate 58 by means of swivel coupling 70. Piston plate 66 sealingly engages the confronting surface of member 64 such as by an O-ring seal 72, such that chamber 74 defined by the interior of member 64 and the confronting surface of piston plate 66 can be pressurized to cause slidable movement of cylinder member 64 into chamber 12. It will be appreciated that member 64 functions as a movable cylinder with respect to stationary piston 66, in contrast to the usual circumstances where a piston is movable with respect to a stationary cylinder. By use of a movable cylinder, the seal between the cylinder and its associated piston is isolated from the melted glue within chamber 12, as a result of which, the melted glue cannot interfere with the pneumatic apparatus of the gun.

A handle 14 is affixed to plate 58 and contains actuating means for applying operating pressure which includes a trigger assembly 48. An, input pneumatic tube 76 typically extends from the bottom of the handle for connection to an operating gas source. A coverplate 118 shields tube 42 and its associated fittings and electrical wirings to heaters 52 and heat sensor 54.

Venting means 47 is disposed within trigger valve 80 for releasing to the ambient atmosphere operating gas within chamber 37 and conduit 42 upon deactuation of the trigger 82. Venting means 47 comprises a valving mechanism well known in the art.

Operating gas of suitable operating pressure, usually pressurized air, is applied from a suitable source (not shown) via input tube 76 and fitting 78 to trigger assembly 48 which includes a trigger valve 80 which is normally closed and which, upon actuation of trigger 82, is opened to permit flow of operating gas to T-coupling 90. From T-coupling 90, operating gas flows simultaneously to chamber 37 via conduit 42 and to chamber 74 via passages 88 in plate 58 and member 68. Member 68 includes a passage 96 which extends from a port 98 to the surface of piston 66 within chamber 74 and which terminates at the opposite end of member 68 at a port 100 in alignment with port 94 when member 68 is in the closed position, as shown in FIG. 1, with cylinder 64 slidably disposed for movement within chamber 12. With member 68 in a raised position, port 100 is not in fluid communication with port 94, such that operating gas cannot be transmitted to chamber 74 with cylinder 64 outside of its operating position within chamber 12. The decoupling of ports 94 and 100 is provided upon relatively slight angular movement of swivel 70.

A dump valve 130 is disposed within member 68 and in communication with passages 88. Dump valve 130 is adapted to permit pressurized gas to flow to chamber 74 via passages 88 upon actuation of trigger 82. When trigger 82 is deactuated, dump valve 130 allows the pressurized gas to flow from chamber 74 through exhaust port 131 and to the ambient atmosphere in a manner well known to those skilled in the art.

The tube 10 defining chamber 12 is of a thermally insulative material to minimize the conduction of heat to the gun exterior and to the adhesive cartridge. The glue cartridge 14 is itself a good thermal insulator having nearly the same characteristics as the tube material, and thus the heat provided by heater block 16 remains concentrated near this block and the operating temperature of tube 10 remains relatively low. The heater block 16 and the pneumatic drive components are typically fabricated of aluminum and, of course, can be of any suitable materials to suit specific performance requirements.

The operation of the gun will be now more fully described. The gun is loaded by retracting cylinder 64 out of chamber 12 and into extension surface 60, this cylinder being placed in its raised position and glue cartridge 14 being inserted within chamber 12. Cylinder 64 is then returned to its downward position and pushed forward into chamber 12 and into engagement with cartridge 14. Upon actuation of trigger 82, venting means 47 and dump valve 130 are closed, and pressurized gas is directed via the passages 88 in plate 58 and member 68 and to chamber 74 to force cylinder 64 inward of chamber 12 and thereby urge cartridge 14 into engagement with heater block 16 for melting of the confronting portions of the cartridge. Operating gas is also applied via tube 42 and fitting 40 to the chamber 37, thereby causing chamber 37 to expand and to urge nozzle 24 forward into an open position. Melted adhesive then is able to flow via passages 20 and 21 through nozzle 24 and out the discharge orifice 26 past needle 30 and onto the work surface.

Upon release of trigger 82, trigger valve 80 is closed to prevent further application of pressurized gas to cylinder 64 and to chamber 37. Venting means 47 and dump valve 130 are then opened, thereby permitting the release of operating gas into the working atmosphere and permitting the nozzle 24 to return in a direction towards block 16 to the closed position under the influence of biasing mechanism 31 as the gas in chamber 37 is vented. The tip of needle 30 sealingly engages discharge orifice 26 in this closed position. The biasing mechanism 31 is adjusted to exert sufficient pressure to overcome the residual pressure within the cylinder 12 and prevent any adhesive material from leaking through discharge orifice 26.

Any buildup of glue or carbon that may occur on needle 30 will not in any way affect the closure of nozzle 24 or the sealing of discharge orifice 26, since the needle remains in a stationary position as the nozzle 24 slides inward towards heating block 16 and into sealing engagement with the tip of needle 30. Any carbon deposits or glue present on the tip of the needle 30 will be removed by the action of nozzle 24 as it engages the tip of needle 30. Because the needle is stationary, no adjustment is needed thereto to achieve an effective seal with the discharge orifice 26. As the nozzle 24 retracts to a closed position, residual glue within the discharge orifice 26 is captured therein and is not pushed through the discharge orifice 26 onto the work surface. Thus, no pulsing action results from forcing the additional glue out of the discharge orifice 26 during closure of the nozzle 24, since the adhesive is wiped back rather than pushed forward by the action of the nozzle 24. Once the nozzle 24 is in a closed position, the biasing mechanism 31 prevents the nozzle 24 from opening and permitting adhesive from leaking therefrom. However, the biasing mechanism 31 may be adjusted so that if extreme pressure builds up within the cylinder 12 or the passages 20 or 21, this pressure will force the nozzle 24 into an open position, permitting release of the excessive pressure and thus preventing a back-up condition of the glue.

Figure 2:
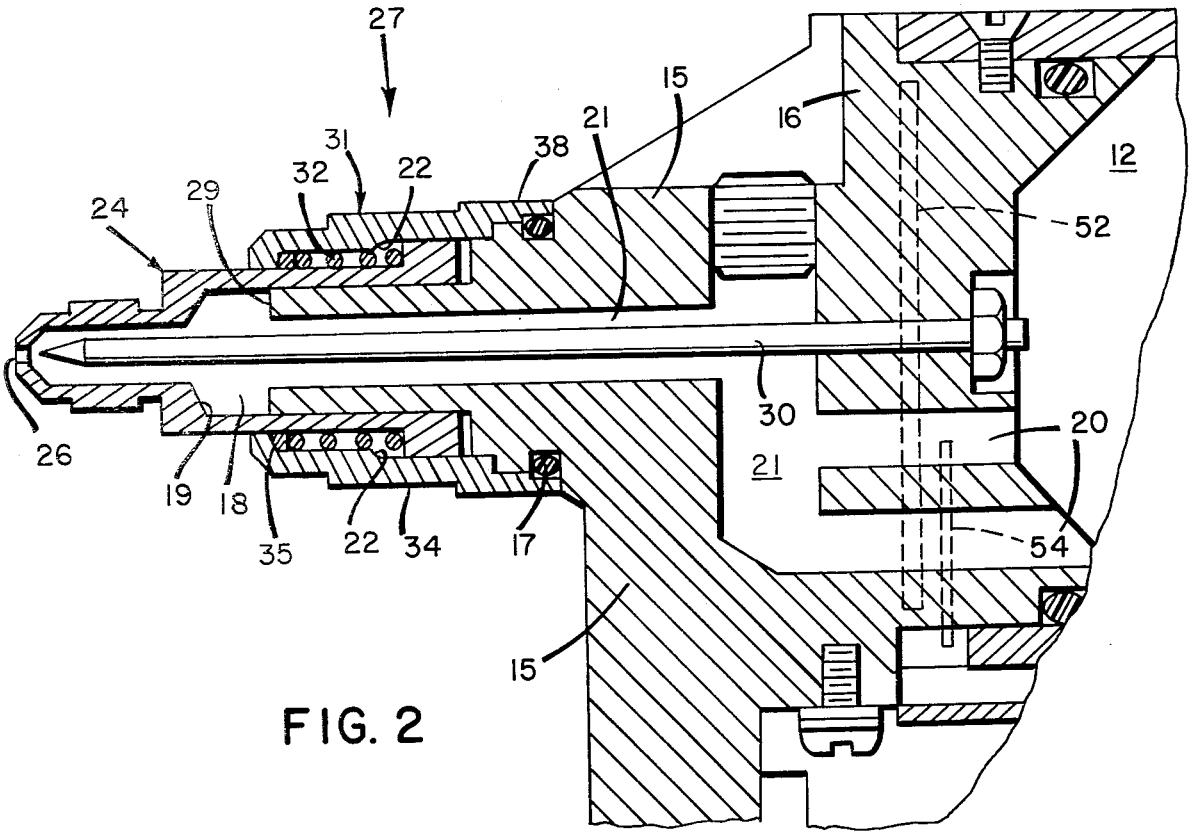
FIG. 2 is a cutaway sectional elevation view of another embodiment of the invention.

An alternative form of nozzle valve 27 is shown in FIG. 2 in which the nozzle 24 is urged into an open position by the glue pressure within chamber 18 and within passages 20 and 21. In this alternative form of the invention, chamber 37 and conduit 42 are not present, and biasing mechanism 31 provides a closing bias sufficiently strong to prevent opening of the nozzle 24, except under a high predetermined pressure created within the chambers 12 and 18 and within the passages 20 and 21. In this embodiment, the operating pressure necessary for opening nozzle 24 is supplied only to chamber 74. Operating gas is supplied upon actuation of the trigger 82 to chamber 74 thereby forcing cylinder 64 inward and urging cartridge 14 into engagement with heater block 16. As the adhesive melts, it fills passages 20 and 21 and chamber 18, creating pressure therein, and when this pressure reaches a predetermined level, nozzle 24 is forced into the open position, and adhesive passes through discharge orifice 26 onto a working surface. Nozzle 24 is closed by release of trigger 82 which opens dump valve 130 and prevents further application of pressurized gas to cylinder 74. Gases within chamber 74 are vented through dump valve 130 and as a result, solid adhesive is no longer pushed into contact with heater block 16 and accelerated melting of the adhesive ceases, thereby reducing pressure within passages 20 and 21. When this pressure falls below a predetermined level, biasing mechanism 31 actuates nozzle 24, returning it to a closed position so that needle 30 is in sealing engagement with discharge orifice 26.

Figure 3:
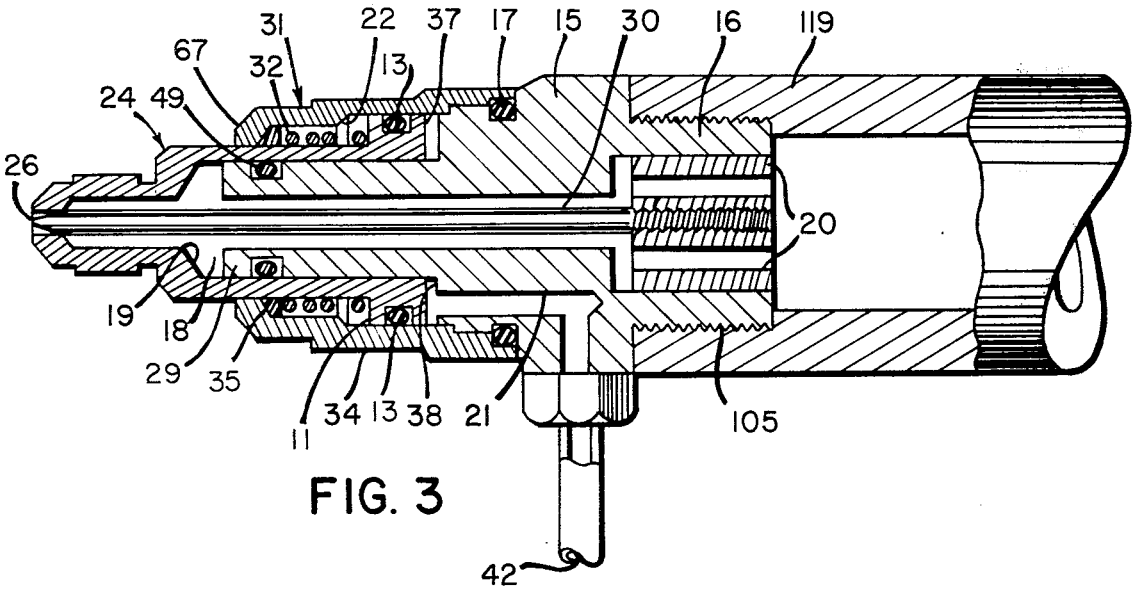
FIG. 3 is a sectional elevation view of another embodiment of the invention.

Another embodiment of the invention is shown by FIG. 3 in which a needle valve nozzle mechanism of FIG. 1 is adapted to be attached to any type of pressurized dispenser, such as a bulk hot melt unit. The embodiment of FIG. 3 is a self-contained unit comprising a trigger mechanism for controlling the flow of gases into and from chamber 37 by means of conduit 42, as described for the embodiment shown in FIG. 1. In FIG. 3, the block 16 contains screw threads 105 adapted to engage similar screw threads in a connecting tube 119 of a bulk hot melt unit and to thereby sealingly affix such a tube 119 to the block 16.

The adhesive is preferably melted and its temperature raised to the desired level by means of a source of heat externally applied to tube 119 in a manner well known to those skilled in the art. Tube 119 is formed of a heat conductive material, as is block 16, so that the externally applied heat is conducted through and along tube 119 and through block 16 to the tip of needle 30, as shown in FIG. 1, to maintain the adhesive in the desired melted condition until it is dispensed from discharge orifice 26. The heaters 52 and heat sensing means 54 shown in FIG. 1 may also be employed to melt the adhesive in the embodiment of FIG. 3, instead of the external heat source described herein.

Biasing mechanism 31 is adjusted so as to maintain the nozzle 24 in a closed position during non-operating periods and to prevent the nozzle 24 from opening due to the ambient pressure within the bulk hot melt unit which may typically be about twenty pounds per square inch. The nozzle 24 is opened by the application of pressurized operating gas to chamber 37, as described in FIG. 1, thereby allowing the ambient pressure of the adhesive in chamber 12 and passages 20 and 21 to urge the adhesive through discharge orifice 26. Similarly, the nozzle 24 is returned to a closed position by the venting of gases from chamber 37 through venting means 47 upon deactuation of the trigger 82. Various other modifications and alternative implementations can be made without departing from the true scope of the invention. Accordingly, it is not intended to limit the invention by what has been particularly shown and described, except as indicated in the appended claims.

What is claimed is:

1. For use in a hot melt adhesive applicator, a needle valve nozzle assembly comprising:

a nozzle housing adapted for connection to a chamber containing a quantity of hot melt adhesive;

a reciprocable nozzle disposed at the discharge end of said housing and having a discharge orifice at one end for the discharge of adhesive therefrom and a second end facing said nozzle housing;

a conduit in communication between said chamber and said discharge orifice for conducting said adhesive to said discharge orifice;

a stationary needle fixedly mounted to said housing and extending through at least a portion of said conduit and into said discharge orifice, said needle being in sealing engagement with said discharge orifice when said nozzle is in a closed position;

biasing means at the discharge end of said housing and operative to urge said nozzle into said closed position to prevent flow of adhesive through said discharge orifice;

a sleeve disposed at the discharge end of said chamber surrounding a portion of said nozzle and forming an annular compartment adjacent said second end of said nozzle;

manually operative trigger means adapted for coupling said annular compartment to a source of operating gas of a predetermined operating pressure to permit the application of operating gas to said compartment for urging said nozzle into an open position to permit the dispensing of adhesive from said discharge orifice; and venting means in communication between said compartment and the ambient atmosphere for venting operating gas from said compartment upon deactuation of said trigger means, thereby allowing said biasing means to urge said nozzle into its closed position.

2. The invention according to claim 1 further comprising:

heater means disposed at the discharge end of said chamber and into engagement with which adhesive is urged to melt a quantity thereof; and driving means for urging adhesive into engagement with said heater means and for urging a melted quantity of adhesive into said conduit and through said discharge orifice when said nozzle is in its open position.

3. The invention according to claim 2 wherein said driving means comprises:

a cylindrical member disposed for sliding movement in said chamber and having a closed end facing said discharge end and an opposite open end;

a disc disposed in a fixed axial position in said open end of said cylindrical member in slidable gas-sealing relationship with the confronting wall thereof and defining a gas-tight volume within said cylindrical member;

valve means disposed on said disc in communication with said volume;

tube means allowing communication between said trigger means and said valve means and allowing communication between said venting means and said valve means for applying operating gas to said volume through said valve means upon actuation of said trigger means and for conducting said operating gas from said volume through said valve means to said venting means upon deactuation of said trigger means.

4. The invention according to claim 1 wherein said chamber is threadably detachable from said needle valve nozzle assembly.

5. For use in a hot melt adhesive applicator, a needle valve nozzle assembly comprising:

a nozzle housing adapted for connection to a chamber containing a quantity of hot melt adhesive;

a cylindrical nozzle having a discharge orifice at one end and an annular lip at the opposite end and being slidably attached to the discharge end of said housing;

a cylindrical sleeve surrounding a portion of said nozzle containing said lip and secured to the discharge end of said housing;

heater means within said housing between the discharge end of said chamber and said nozzle and into engagement with which said adhesive is urged to melt a quantity thereof;

a passage extending through said nozzle housing and communicating with said chamber for flow of melted adhesive therethrough;

a stationary needle fixedly mounted at one end to said heater means and extending through said passage into said nozzle with the distal end in sealing engagement with said discharge orifice when said nozzle is in a closed position;

spring means disposed within an annular space between confronting portions of said nozzle and said sleeve and operative to urge said nozzle inward into a normally closed position with the distal end of said needle in sealing engagement with the discharge orifice of said nozzle;

an expansible adhesive compartment between inner surfaces of said nozzle and said housing;

sealing means disposed between relatively sliding surfaces of said nozzle, said housing and said sleeve in positions isolated from the melted adhesive;

an annular pneumatic chamber formed between said lip and confronting portions of said housing and sleeve; and a conduit communicating with said pneumatic chamber for applying operating gas thereto from an external source to urge said nozzle into its open position for dispensing of adhesive from said discharge orifice.

6. The invention according to claim 5 wherein said cylindrical sleeve includes an inwardly extending annular flange disposed therearound; and wherein said spring means includes a coil spring disposed around the outer surface of said nozzle and captured between said flange and said lip.

7. The invention according to claim 6 wherein said sealing means includes:

a first ring seal on said housing and in sealing engagement with the confronting surface of said nozzle; and a second ring seal on said nozzle near said lip and in sealing engagement with the confronting surface of said sleeve.

8. The invention according to claim 7 further including a third ring seal between said nozzle housing and said sleeve to prevent leakage of operating gas applied to said annular pneumatic chamber.

9. The invention according to claim 5 wherein said nozzle includes an annular shoulder portion surrounding said needle and defining a portion of said expansible adhesive compartment and against which melted adhesive is urged to cause movement of said nozzle into its open position.

10. The invention according to claim 5 wherein said needle is operative to conduct heat from said heater means to said distal end of said needle to maintain the adhesive along the length thereof in intended melted condition.

11. A hot melt adhesive gun for use with a cartridge of normally solid thermoplastic adhesive, said gun comprising:

a housing defining a chamber adapted to contain a cartridge of normally solid thermoplastic adhesive;

heater means disposed at the discharge end of said chamber and into engagement with which said adhesive cartridge is urged to melt a confronting quantity thereof;

a reciprocable nozzle disposed at the discharge end of said housing and having a discharge orifice for the discharge of said adhesive;

a conduit extending from said chamber through said heater means to said nozzle for conducting said adhesive to said nozzle;

a stationary needle fixedly mounted to said heater means and extending through said conduit and said nozzle means and into said discharge orifice, said needle being in sealing engagement with said discharge orifice when said nozzle is in a closed position;

biasing means affixed to said nozzle for biasing said nozzle into its closed position;

pneumatically actuated means for slidably urging said nozzle in a direction outward from said stationary needle into an open position wherein said discharge orifice projects beyond said needle and out of engagement therewith, thereby allowing said adhesive to flow through said discharge orifice from said conduit;

driving means disposed for sliding movement in said chamber and pneumatically actuable to urge said adhesive cartridge into engagement with said heater;

trigger means pneumatically coupled to said driving means and to said pneumatically actuable means;

venting means communicating said driving means and said pneumatically actuable means with the working atmosphere;

said trigger means being operative upon actuation to apply operating gas to said driving means and to said pneumatically actuable means to urge said adhesive cartridge in said chamber into engagement with said heater means, and to urge said nozzle into its open position;

said trigger means being operative upon deactuation to discontinue application of operating gas to said driving means and to said pneumatically actuable means and to couple said driving means and said pneumatically actuable means to said venting means, thereby allowing said biasing means to urge said nozzle into its closed position.

12. The invention according to claim 11 wherein said biasing means comprises:

a sleeve surrounding a portion of said nozzle and being secured to the discharge end of said housing;

an annular lip formed on an exterior surface of said nozzle and projecting outwardly therefrom toward said sleeve;

an annular flange formed on said sleeve and protruding inwardly toward said nozzle; and a coil spring surrounding the outer surface of said nozzle and captured between said lip and said flange.

13. The invention according to claim 11 wherein said driving means comprises:

a cylindrical member disposed for sliding movement in said chamber and having a closed end facing said discharge end of said chamber and an opposite open end;

a disc disposed in a fixed axial position in said open end of said cylindrical member in slidable gas-sealing relationship with the confronting wall thereof and defining a gas-tight volume within said cylindrical member;

valve means disposed on said disc in communication with said volume; and tube means allowing communication between said trigger means and said valve means and allowing communication between said venting means and said valve means for applying operating gas to said volume through said valve means upon actuation of said trigger means and for conducting said operating gas from said volume through said valve means to said venting means upon deactuation of said trigger means.

14. For use in a hot melt adhesive applicator, a needle valve nozzle assembly comprising:

a nozzle housing adapted for connection to a chamber containing a quantity of hot melt adhesive;

a reciprocable nozzle disposed at the discharge end of said housing and having a discharge orifice at one end for the discharge of adhesive therefrom and a second end facing said nozzle housing;

a conduit in communication between said chamber and said discharge orifice for conducting said adhesive to said discharge orifice;

a stationary needle fixedly mounted to said housing and extending through at least a portion of said conduit and into said discharge orifice, said needle being in sealing engagement with said discharge orifice when said nozzle is in a closed position;

biasing means operative to urge said nozzle into said closed position to prevent flow of adhesive through said discharge orifice;

pneumatically actuated means disposed adjacent said second end of said nozzle and adapted for urging said nozzle into an open position upon the application of pneumatic pressure thereto, said discharge orifice of said nozzle being spaced from said needle when said nozzle is in an open position;

actuating means adapted to apply pressurized operating gas to said pneumatically actuated means for opening said nozzle and to discontinue application of pressurized operating gas to said pneumatically actuated means and to vent said pneumatically actuated means to an exterior atmosphere to permit said biasing means to urge said nozzle into its closed position.

* * * * *